United States Patent [19]

Logan

[11] 4,303,092

[45] Dec. 1, 1981

[54] SIPHONIC IRRIGATION APPARATUS

[76] Inventor: John K. Logan, Oakville, Narrabri, New South Wales, Australia, 2390

[21] Appl. No.: 91,535

[22] Filed: Nov. 5, 1979

[51] Int. Cl.[3] ..... F04F 10/00

[52] U.S. Cl. ..... 137/142; 137/124; 137/152; 137/153; 137/342

[58] Field of Search ..... 137/124, 142, 147, 152, 137/153, 342

[56] References Cited

U.S. PATENT DOCUMENTS

| | | | |
|---|---|---|---|
| 340,574 | 4/1886 | Handy | 137/142 X |
| 627,059 | 6/1899 | Graham | 137/147 X |
| 2,272,655 | 2/1942 | Briese | 137/152 X |
| 2,688,461 | 9/1954 | Simpson | 137/147 X |
| 3,021,860 | 2/1962 | Gandy | 137/152 X |

FOREIGN PATENT DOCUMENTS

| | | | |
|---|---|---|---|
| 246201 | 11/1969 | U.S.S.R. | 137/152 |

*Primary Examiner*—Gerald A. Michalsky
*Attorney, Agent, or Firm*—Mahoney & Schick

[57] ABSTRACT

The invention provides a siphonic apparatus to effect irrigation of a field from a water supply. The apparatus comprises a bridging structure which includes a chassis fabricated from spaced longitudinal bottom members, spaced longitudinal top members interconnected by cross members, vertical struts, diagonal braces and side plates to form a rigid structure having a central elevated section and downwardly angled end sections, the ends of which being on substantially the same plane as the surface supporting the chassis.

At least one siphonic tube is rotatably, transversely supported in the chassis. The tube has an inlet portion and an outlet portion which extend from either side of the chassis, the tube being rotatable in the chassis from a position where the inlet and outlet portions are clear of the surface supporting said chassis for transportation purposes to a position where said inlet and outlet portions are in a plane normal to the horizontal axis of said tube, said tube having a suction valve located adjacent its inlet and a valve to selectively open and close said outlet.

In its preferred form the spaced top members have decking fixed therebetween and constituting wheel tracks to support a vehicle being driven over said bridging structure.

5 Claims, 4 Drawing Figures

SIPHONIC IRRIGATION APPARATUS

BACKGROUND OF THE INVENTION

This invention relates to siphons and it is particularly concerned with siphonic apparatus for agricultural and/or horticultural use.

In irrigated areas it is customary to provide irrigation canals adjacent crop growing fields. Water is admitted to such canals from a source of supply such as another canal, river or dam and is lifted from the source of supply by pumps for distribution over the field. The pumping of water in this manner is costly and usually involves the use of power operated pumps to distribute water to the field. In large fields it is necessary to have a large number of pumping units spaced along the canal in order to effect adequate simultaneous irrigation of the whole field. The placement and removal of pumping units along the canal is time consuming in terms of labor and the cost of such pumping units in order to draw sufficient supplies of water is high. Furthermore, it is essential that the areas to be irrigated be provided with an embankment adjacent the water supply and above the water level. This embankment constitutes a carriageway whereby vehicles can move along the embankment for the purpose of placing the pumping units in location. Most embankments are relatively narrow and when the pumping units are placed in position it has in many cases proved difficult if not impossible to drive a vehicle therealong without moving the pumping units. In consequence, there has been a long felt need for mobile inexpensive means of irrigating fields from a source of water which is so constructed that a vehicle can conveniently proceed along an embankment without moving the pumping means.

OBJECTS AND SUMMARY OF THE INVENTION

The present invention provides a siphonic apparatus to effect irrigation of a field from a source of water, the surface of the water supply being sufficiently above the field to permit irrigation by siphonic action and in its preferred form the invention also includes bridging means whereby a vehicle may pass over the siphonic apparatus when it has been placed in position without effecting its operation.

The invention in its broadest aspect comprises a siphonic apparatus, said apparatus comprising a bridging structure which includes a chassis, at least one siphonic tube rotatably, transversely supported in said chassis, said tube having an inlet portion and an outlet portion which extend from either side of the chassis, said tube being rotatable in said chassis from a position where the inlet and outlet portions are clear of the surface supporting said chassis for transportation purposes to a position where said inlet and outlet portions are in a plane normal to the horizontal axis of said tube, said tube having a suction valve located adjacent its inlet and a valve to selectively open and close said outlet.

BRIEF DESCRIPTION OF THE DRAWINGS

One embodiment of the invention will now be described with reference to the accompanying drawings, in which.

DESCRIPTION OF THE BEST EMBODIMENTS CONTEMPLATED

Figure 1:
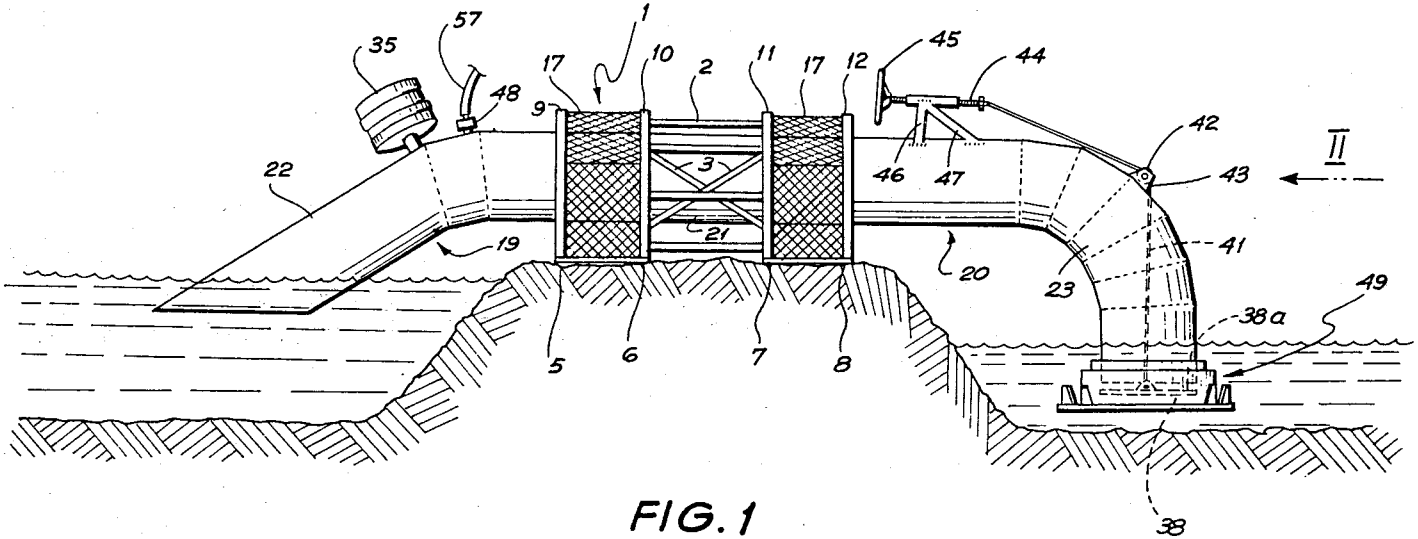
FIG. 1 is an end view of the siphonic apparatus.

Referring now to the accompanying drawings, the apparatus comprises a bridging structure which includes a chassis, indicated generally by the reference 1 which supports the component parts of the apparatus.

The chassis is fabricated from cross members 2, diagonal members 3, vertical struts 4, spaced bottom members 5, 6, 7 and 8 which constitutes skids which support the chassis on the ground and facilitate its movement from one location to another.

The chassis also includes spaced top members 9, 10, 11 and 12. The top members have a middle section 13 and downwardly angled end sections 14 and 15 which are secured at their outer ends to the bottom members 4, 5, 7 and 8.

Figure 2:
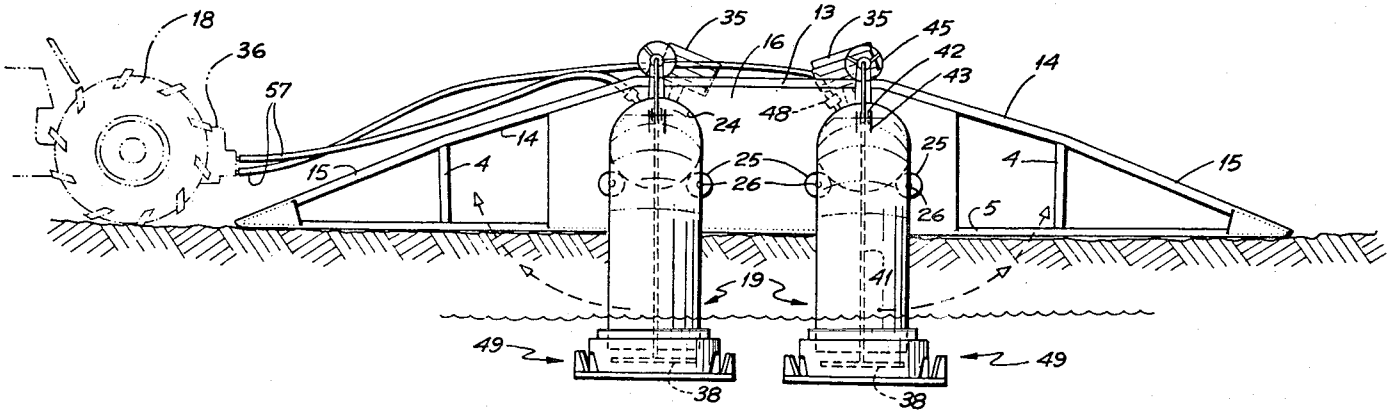
FIG. 2 is a side view of the siphonic apparatus from the outlet side.

Side plates 16 are located between the top members 9 and 10 and 11 and 12 and the bottom members 5 and 6 and 7 and 8. The side plates are secured to the cross members 2. A metal decking 17 of the open mesh type is secured between the top plates 9 and 10 and 11 and 12 and is supported on the cross members 2. This decking forms wheel tracks whereby a vehicle may be driven over the chassis. The chassis is provided with hitch means (not shown) of conventional type whereby the chassis may be connected to a tractor 18 only part of which is shown in FIG. 2 for the purpose of moving the apparatus from one location to another.

In the embodiment of the invention being described the apparatus has two siphonic tubes designated generally by the references 19, 20. It will be appreciated, however, that the invention will work equally well with one or more than two tubes but for practical purposes it is preferred to utilize two tubes. The respective tubes are identical.

Figure 3:
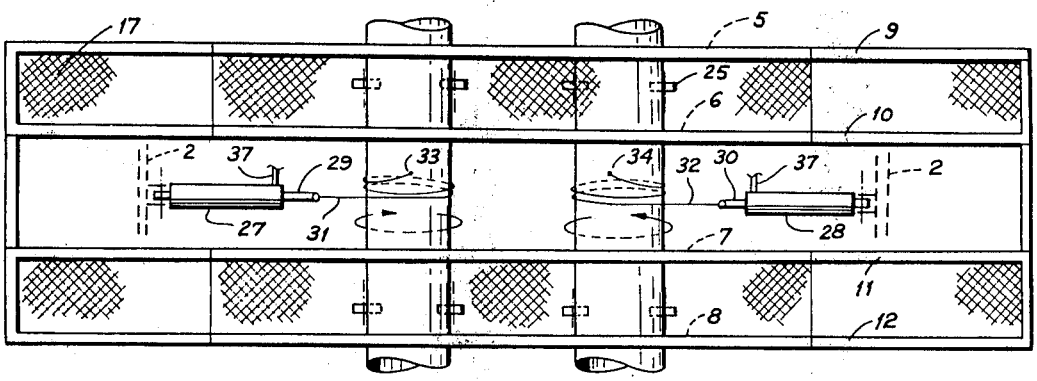
FIG. 3 is a plan view.
Figure 4:
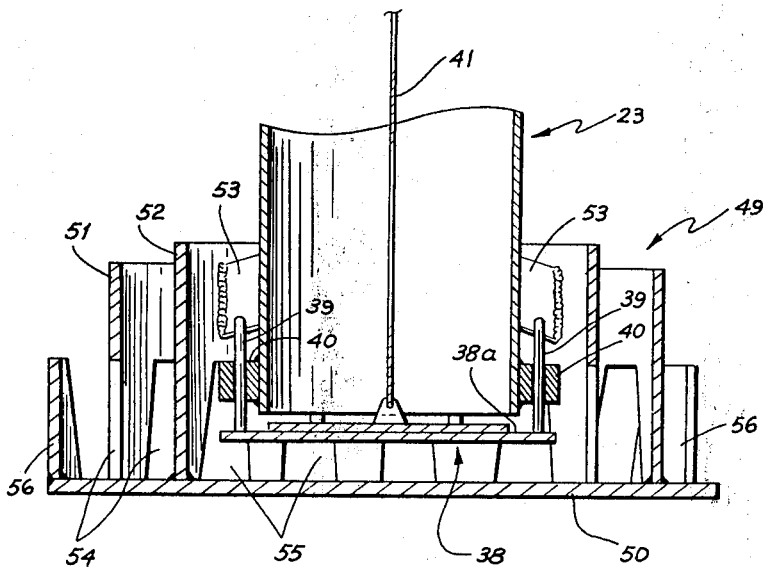
FIG. 4 is a sectional view showing details of the plate valve and diffuser plate from the outlet end of the apparatus.

Each tube has a center portion 21, an angled inlet portion 22 and a bent outlet portion 23. The center portion passes through openings 24 in the respective side plates and is rotatably supported on rollers 25 mounted on shafts 26 fixed in the chassis. Two air cylinders 27, 28 are fixed to the respective cross members 2, shown by dotted lines in FIG. 3. The piston rods 29, 30 of these cylinders are fixed to one end of cables 31, 32 which are wound about the central portion of the tubes 19 and 20. The free end of each cable is fixed as at 33, 34 to each tube.

Each tube is provided with counter weights 35 which are offset with respect to a plan normally to the axis of the central portion 21 of the tubes 19 and 20. The purpose of these counter weights is to normally retain the tubes with the angled inlet portions 22 and the bent outlet portions 23 facing downwardly as illustrated in FIG. 1.

The air cylinders are actuated by a pump 36 mounted on the tractor 18 through a connection tube 37. On actuation of the cylinders the tubes 19 and 20 can be partially rotated from the position illustrated in FIG. 1 to a position where the angled outlet portions 22 and the bent inlet portions 23 are located substantially horizontally relative to the chassis and clear of the ground for transportation purposes.

A plate valve 38 having a seating surface 38*a* is guided between the open and closed position by a number of rods 39 fixed to the plate valve and slideable in sleeves 40 fixed to each tube adjacent its outlet end. The valve is normally urged towards its open position when the siphonic apparatus is in operation by the weight of water in the tube and is moved to its closed position by a cable 41 which is anchored to the plate valve and passes through the tube, through an outlet which has a sealing gland therein and over a pulley 42 supported in brackets 43. The free end of the cable is connected to the spindle 44 of a valve operating wheel 45 fixed by brackets 46, 47 to the central portion of each tube.

Each tube is further provided with a valve controlled suction vent 48 adjacent the end of the central portion 21 remote from the outlet. The function of this suction vent will be explained hereafter.

It will be appreciated that when the siphonic apparatus is in operation large volumes of water will flow through the tubes which will have the effect of damaging the bed and banks of the canal into which the water is being discharged. To minimize against soil erosion in this manner, the outlet end of each tube is provided with a water diffuser member designated by the reference 49. The diffuser member is of circular configuration. It has a bottom plate 50 and spaced concentric side plates 51, 52 spaced inwardly from the outer periphery of the bottom plate. The diffuser member is open at the top and is secured to each outlet by brackets 53 fixed to the tube.

The side walls 51, 52 are provided with an array of outlet ports 54, 55. The outlet ports 54 are in staggered relationship to the outlet ports 55 and baffle plates 56 spaced downwardly from the outlet ports 55 are fixed to the bottom plate 50 to deflect the flow of water therefrom.

In operation the chassis is towed to a suitable location and the siphonic tubes permitted to rotate so that the inlet ends are below water level and the outlet ends are located in the area to be irrigated with their ends below the water level of the water supply.

The plate valves 38 are closed and the suction vent 48 is coupled to the pump 35 by a suction line 57. The pump 35 causes a vacuum to be formed in each of the siphonic tubes which rapidly fill with water. The suction line 57 is closed and the plate valves 37 opened. This causes the siphon to operate and it will continue to operate until the plate valves are closed.

It will be appreciated that the foregoing description describes one embodiment of the invention only. As previously stated the number of siphonic tubes may be varied to suit particular requirements. Instead of using counter weights to urge the siphonic tubes towards their operating position additional air cylinders may be utilized to effect this movement. The air cylinders may be replaced by hydraulic cylinders or mechanical linkages operated by hand wheels should this be found necessary in particular locations. A valve arrangement other than the plate valve described may be used. The plate valve has been selected because it proved to be the simplest and most convenient form of valve to use. It would be readily apparent, however, that other forms of conventional valve arrangements can be used as will be readily apparent to those skilled in the art.

The apparatus described is inexpensive and simple to operate, it can be moved from location to location by a conventional tractor and is capable of handling large volumes of water which is essential in those areas where large scale irrigation is required.

I claim:

1. Siphonic apparatus comprising a chassis, at least one siphonic tube mounted on said chassis with a main axis extending generally horizontally and having an inlet portion and an outlet portion which normally extend generally downwardly from the horizontal axis and from either side of the chassis, means mounting the tube rotatable on the chassis about the horizontal axis, said chassis having an hydraulic cylinder affixed thereon, the cylinder having an operating rod connected to a cable which is passed about the tube, the tube being actuated by the hydraulic cylinder to cause the tube to partially rotate on the chassis radially about its horizontal axis to move the inlet and outlet portions thereof simultaneously upwardly clear of a surface supporting the chassis, said tube having a suction valve located adjacent to its inlet portion and a valve to selectively open and close its outlet portion.

2. Siphonic apparatus as claimed in claim 1 wherein counterweights are fixed to said tube to normally urge said tube to a position where the inlet and outlet portions of the tube are in the normal position extending downwardly from the horizontal axis of the tube.

3. Siphonic apparatus as claimed in claim 1 wherein the tube outlet portion has a water diffuser member secured thereto below the valve at the outlet portion to diffuse a flow of water from said outlet portion.

4. Siphonic apparatus comprising a bridging structure formed by a chassis fabricated from longitudinal top and bottom members interconnected to form a rigid structure having an elevated central section and downwardly angled end sections terminating at generally the same plane as a surface supporting said chassis, the top members having decking fixed thereon and constituting a trackway to support a vehicle being driven over the bridging structure, at least one siphonic tube in the chassis beneath the decking having an inlet portion and an outlet portion which extend downwardly on either side of the chassis, said tube having a suction valve located adjacent to its inlet portion and a valve to selectively open and close said outlet portion.

5. Siphonic apparatus as claimed in claim 4 wherein the outlet portion has a water diffuser member secured thereto downstream of said valve to diffuse a flow of water from said outlet portion.

* * * * *